US005540302A

United States Patent [19]

Nagasawa et al.

[11] Patent Number: 5,540,302

[45] Date of Patent: Jul. 30, 1996

[54] ELEVATOR DOOR WIPER SYSTEM

[75] Inventors: Kazuyuki Nagasawa, Narita; Yuji Matsuzaki, Funagashi, both of Japan

[73] Assignee: Otis Elevator Company, Farmington, Conn.

[21] Appl. No.: 263,625

[22] Filed: Jun. 22, 1994

[30] Foreign Application Priority Data

Jun. 24, 1993 [JP] Japan ..... 5-153134

[51] Int. Cl.[6] ..... B66B 13/06

[52] U.S. Cl. ..... 187/333; 187/334; 49/475.1

[58] Field of Search ..... 187/313, 334, 187/333; 49/120, 116, 475.1, 493.1

[56] References Cited

U.S. PATENT DOCUMENTS

| | | | |
|---|---|---|---|
| 2,794,219 | 6/1957 | Macklanburg | 49/493.1 |
| 3,024,504 | 3/1962 | Miller | 49/493.1 |
| 4,419,844 | 12/1983 | Kreisfeld | 49/475.1 |
| 4,488,387 | 12/1984 | Foti | 49/493.1 |
| 5,131,504 | 7/1992 | Yoo et al. | 187/313 |
| 5,174,675 | 12/1992 | Martin | 187/334 |

*Primary Examiner*—Kenneth Noland
*Attorney, Agent, or Firm*—Joseph P. Abate

[57] ABSTRACT

An elevator wiper (6) includes a sheet steel (7), installed in a removable fashion on side jams (2), (3) which face the surfaces (4*a*), (5*a*) of the elevator doors (4) and (5), and a sponge (8), installed on this sheet steel (7) in contact with the surfaces (4*a*), (5*a*) of the aforementioned doors (4), (5) for wiping dirt off.

4 Claims, 7 Drawing Sheets

ELEVATOR DOOR WIPER SYSTEM

BACKGROUND OF THE INVENTION

1. Technical Field

This invention pertains to an elevator door wiper which wipes off the dirt present on an elevator door such as a hall door.

2. Description of the Prior Art

In the past, when an elevator was operating for a while, this elevator door became immediately dirty. On the other hand, in an elevator installed in a building where entertainment business is conducted, such as a hotel, in order to receive guests with a favorable impression, doors must always be kept free of dirt. Here, in case dirt is attached or present on this type of elevator door, it is necessary to wipe the dirt off. For this reason, sometimes, hotel employees, et al., used to cleanly wipe off the dirt attached on the surface of doors using a piece of soft cloth, etc.

However, conducting a wiping operation for elevator doors up to every nook and corner of doors each time using a piece of cloth, etc., was a considerably complicated matter. Especially in case several elevators were installed, there was a problem in which the wiping operation :required hard labor, and in which it took time.

A principal object of the present invention is to provide a door wiper capable of omitting wiping work (e.g. manual work) in which elevator doors are wiped every time by hand with a piece of cloth, etc.

According to the present invention, a door wiper which executes wiping work is constituted by equipping the door with a base plate material installed in a removable fashion on a member facing the surface of an elevator door and a wiping member installed on this base plate material in contact with the surface of the above-mentioned door for wiping dirt off.

When a door is opened and closed, because the wiping member is in contact with the surface of the door, the dirt disposed on this surface is automatically wiped every time the door is opened and closed. When the wiping member becomes dirty by wiping dirt off, the door wiper (e.g., base plate and wiping member) is removed from its facing member, and it is replaced with a new wiping member.

Further and still other objects of the present invention will become more readily apparent when the following detailed description is taken in light of the accompanying drawing, in which:

DETAILED DESCRIPTION OF THE PREFERRED EMBODIMENTS AND BEST MODE

This invention is explained below based on the figures. FIGS. 1–4 show Application Example 1 of the elevator door wiper according to this invention. In FIGS. 1–4, there are shown:

1. Entrance and exit;

2, 3. Side jam;

4, 5. Door;

6. Door wiper:

7. Steel plate;

8. Sponge; and

9. Screw.

Figure 1:
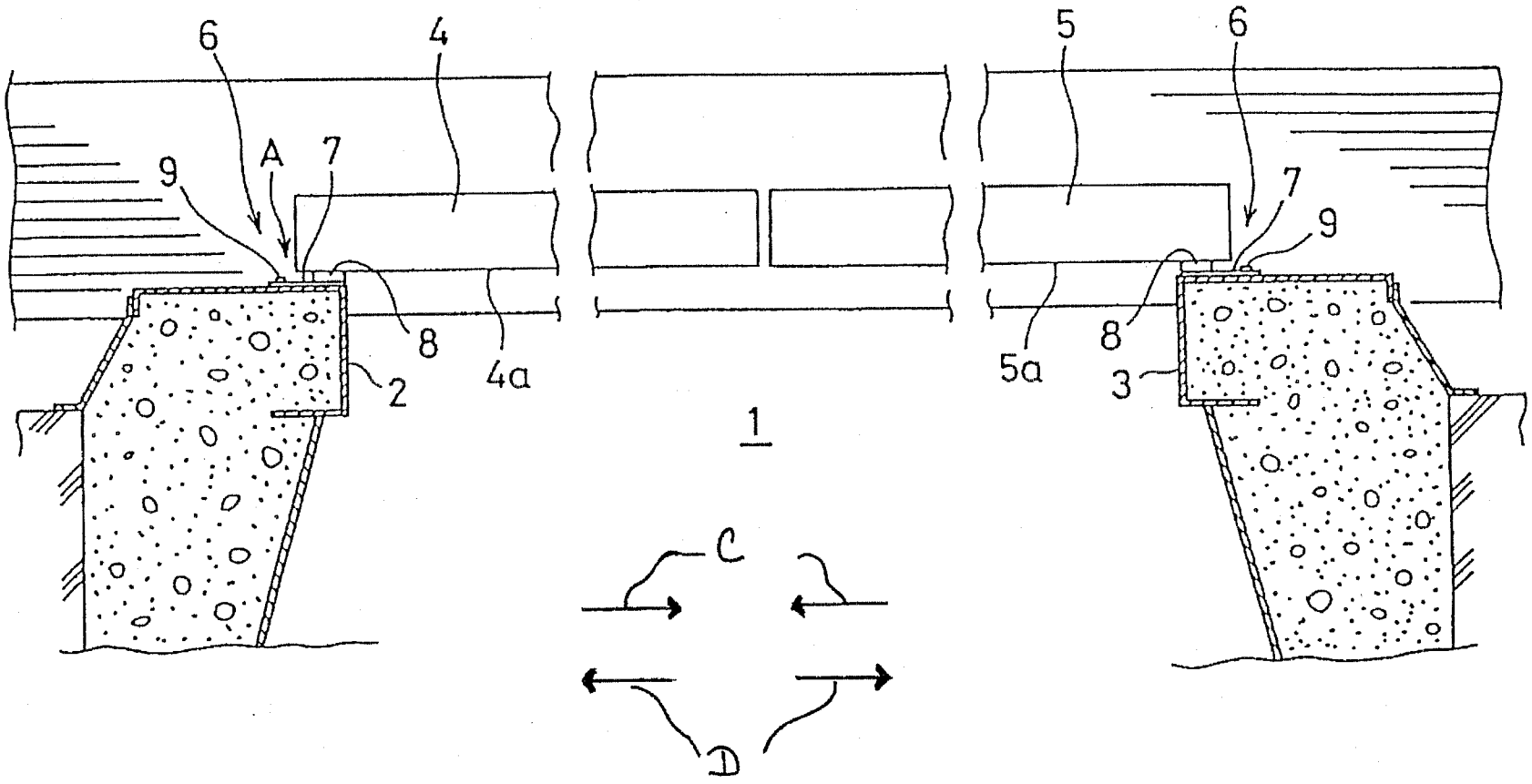
FIG. 1 is a plan view of an entrance and exit of a hallway in which the first application example of the elevator door wiper of this invention is used.

In FIG. 1, 1 is the entrance and exit of an elevator of, e.g. a hotel, and at both sides of the entrance and exit 1, a pair of side jams (facing members) 2 and 3 is installed. At the side jams 2 and 3, a guide rail (not shown in the figure) is installed, and at this guide rail, a pair (double-opening type) of doors 4 and 5 is suspended to be freely opened and closed.

Figure 2:
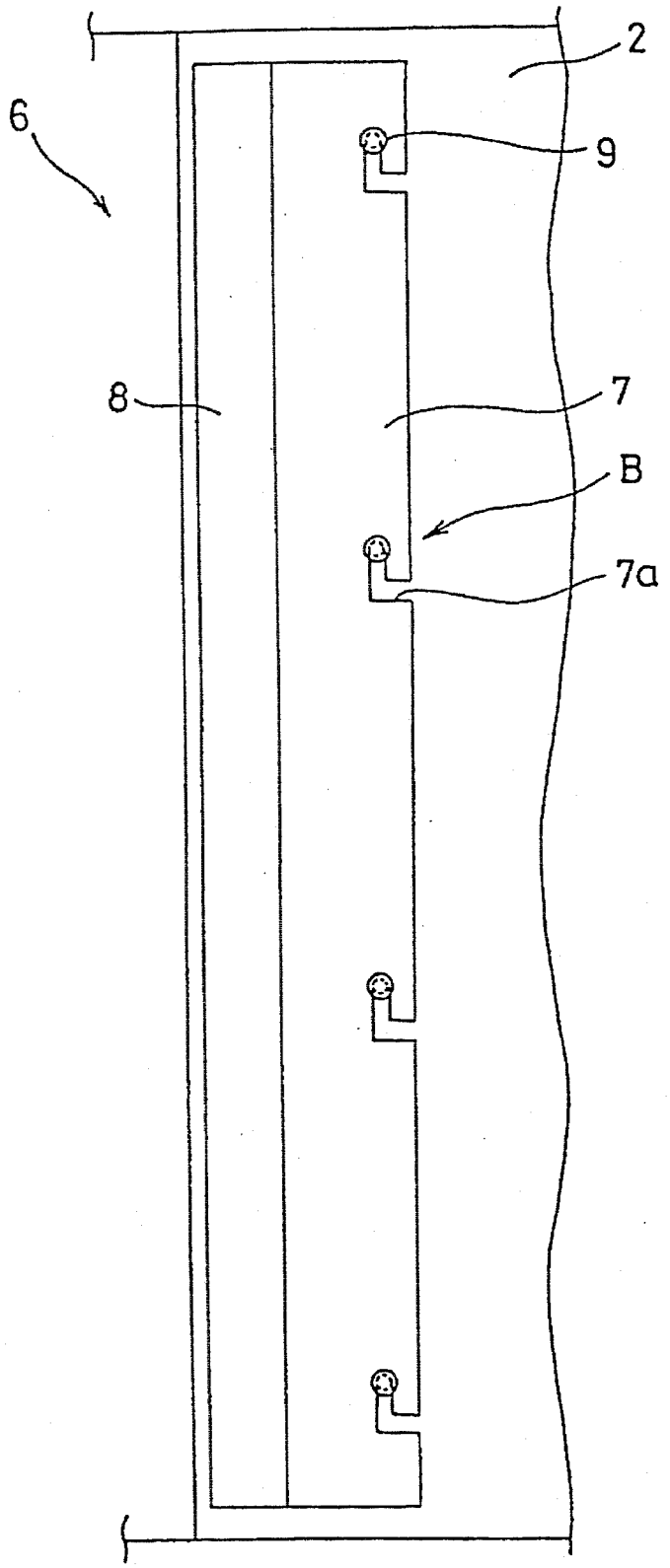
FIG. 2 is a view of an area indicated by an arrow A in FIG. 1.
Figure 3:
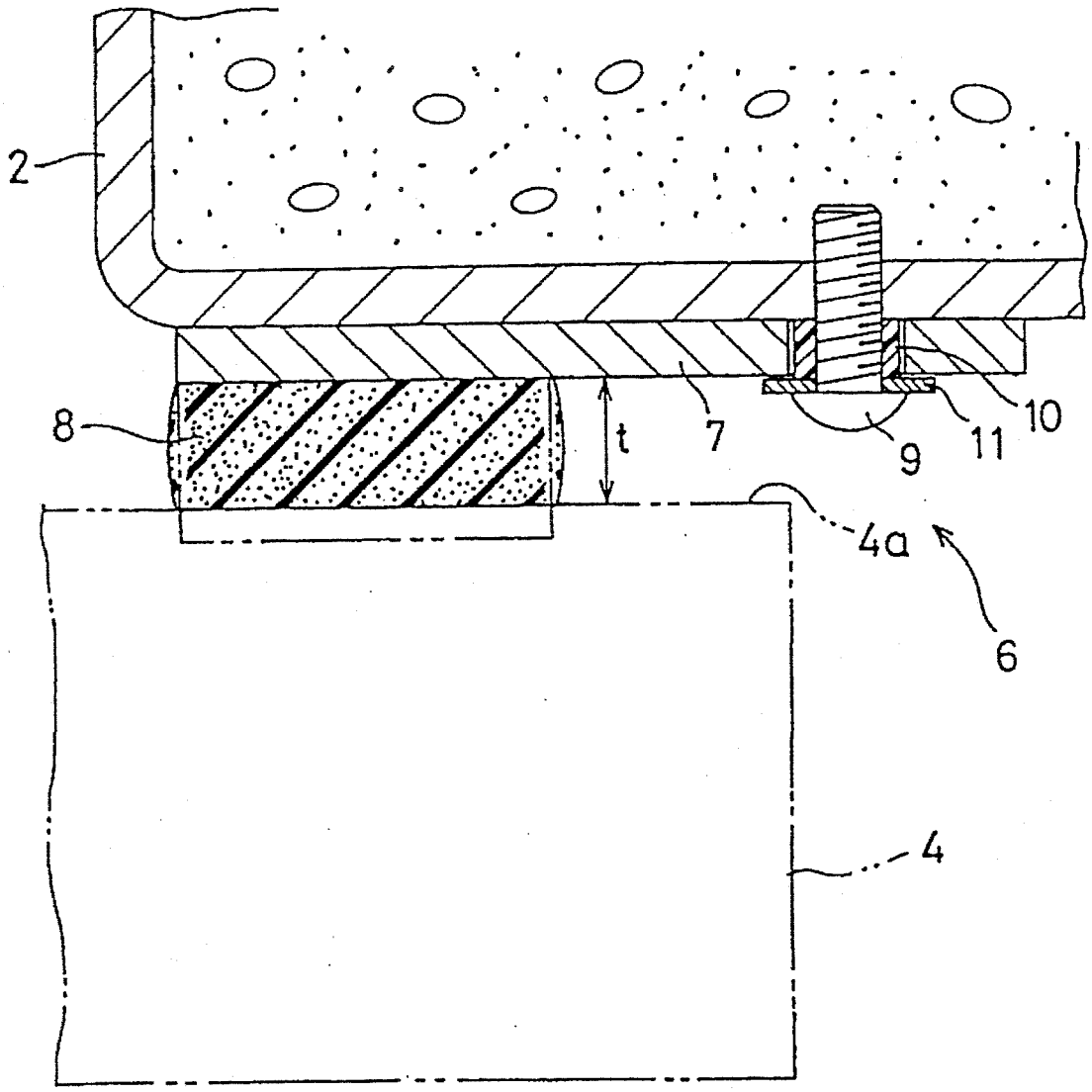
FIG. 3 is a partially enlarged cross section of the top of the area shown by the arrow A in FIG. 1.

In the side jams 2 and 3, the door wiper 6 for wiping the dirt attached on the surfaces 4*a* and 5*a* of the doors 4 and 5 to be opened and closed is installed to be freely removed, respectively. The door wiper 6, as shown in FIGS. 2 and 3, has a steel plate (base plate material) 7 with a slender, rectangular shape as a whole, and the connecting groove 7*a* is formed in a hook shape at one side. To the other side, the sponge (wiping member, felt, etc.) 8 with a slender, thick sheet-like shape is adhered, for example, glued. The thickness of the sponge 8 is considerably thickened in the interval t between the side jam 2 and the door 4, and its length extends over the total height of the door 4. In other words, the sponge 8 is compressed between the jam 2 and the door 4 so that the density of the compressed sponge is greater than the sponge uncompressed. For example, depending upon the composition of the sponge or wiping member, an uncompressed sponge which is approximately one inch thick is approximately one-half inch thick when compressed.

Figure 4:
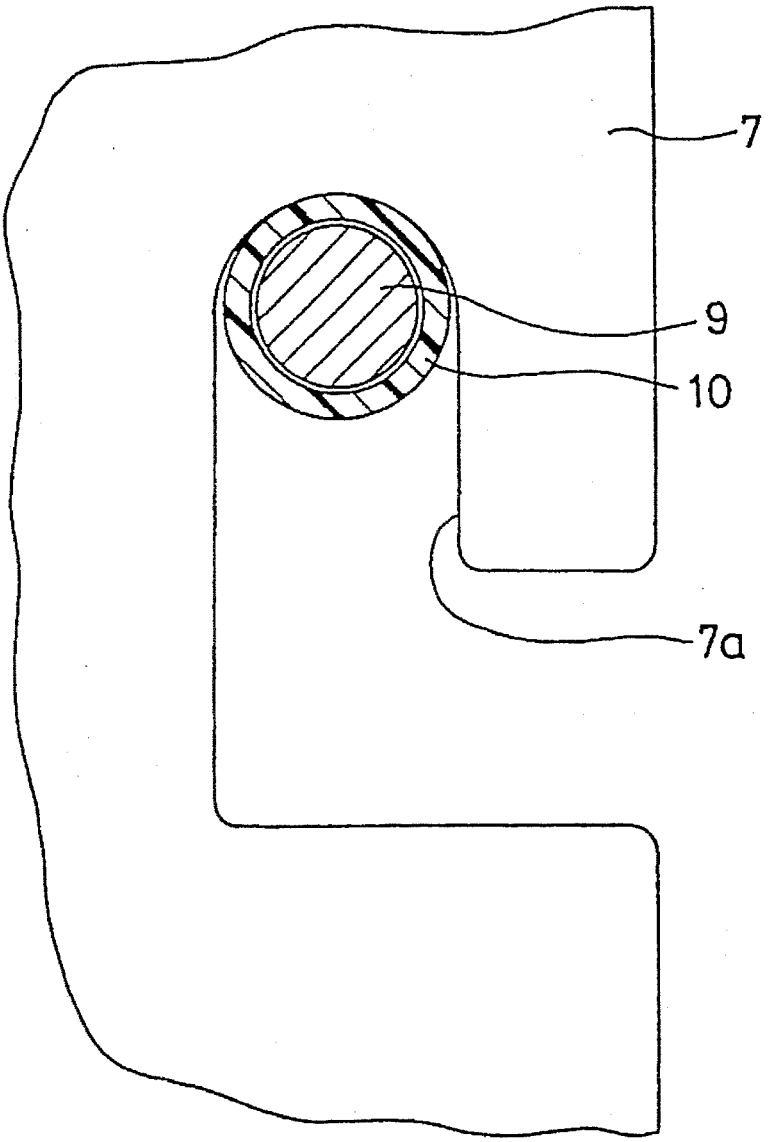
FIG. 4 is a partially enlarged cross section of an area shown by an arrow B in FIG. 2.

On the other hand, several screws 9 are installed in its height direction in the side jam 2, and as shown in FIG. 4, the above-mentioned connecting groove 7*a* is connected (inserted) in the screw 9. At the screw 9, a collar 10 made of a synthetic resin is fixed, so that the connecting groove 7*a* can be connected (to be able to secure the thickness of the steel plate 7), and to stop looseness. Between the collar 10 and the head of the screw 9, the washer 11 for broadly pressing the steel plate 7 is inserted. When the connecting groove 7*a* is inserted into the screw 9, the door wiper 6 is fixed to the side jam 2. At this moment, because the sponge 8, as mentioned above, is considerably thickened in the interval t between the side jam 2 and the door 4, it is pressed and intimately contacts (or slidably adheres to) the surface 4*a* of the door 4.

When the doors 4 and 5 are opened and closed, since the sponge 8 is press-adhered to the surfaces 4*a* and 5*a*, the dirt attached on the surfaces 4*a* and 5*a* is automatically wiped every time the door is opened and closed. When the sponge 8 becomes dirty due to wiping dirt off, the door wiper 6 is removed from the screw 9, and it is replaced with a new sponge 8.

On the other hand, in the door wiper 6, since only one side of it is attached (fixed) to the side jams 2 and 3 via the screw 9, when the doors 4 and 5 are opened and closed, shaking (turning-over) can also be considered. However, since the sponge 8 is also press-adhered to the surface of the side jams 2 and 3, namely, since the door wiper 6 is press-fixed to the side jams 2 and 3, it is not shaken at all.

Figure 5:
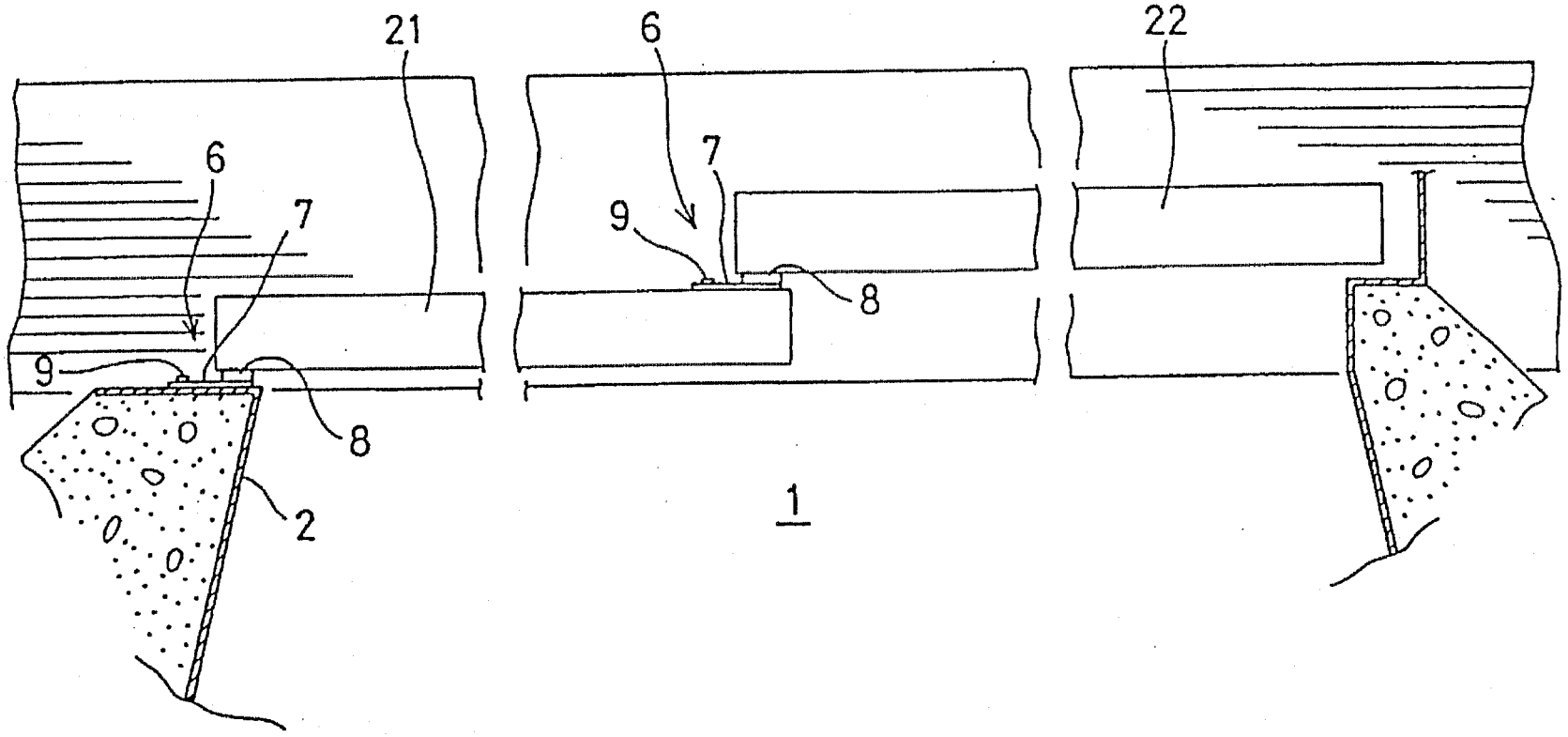
FIG. 5 is a plan view of the entrance and exit of a hallway in which a second application example of the invention is used.

Next, Application Example 2 of the elevator door wiper of this invention is shown in FIG. 5. At the entrance and exit 1 of a hallway, the doors 21 and 22 with one side-opening type (two-speed opening system) are arranged, and at the door (facing member) 21, the door wiper 6 is installed to be freely removed. Also, at the side jam 2, the door wiper 6 is also installed to be freely removed. When the doors 21 and 22 are opened and closed, as mentioned above, the dirt attached on the surface of the doors 21 and 22 is automatically wiped by the door wiper 6.

Figure 6:
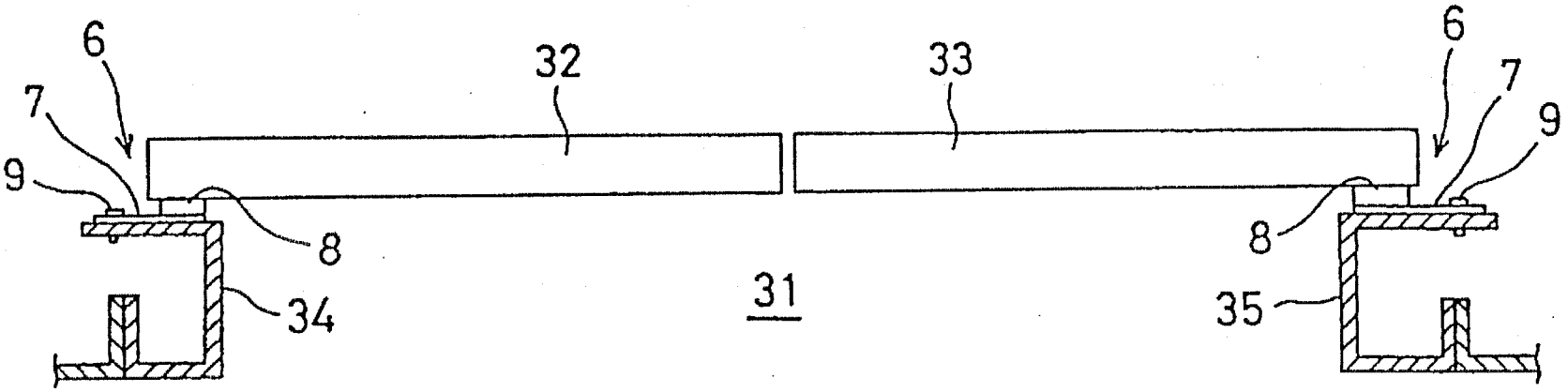
FIG. 6 is a plan view of the entrance and exit of a cage in which another application example of the invention is used.
Figure 7:
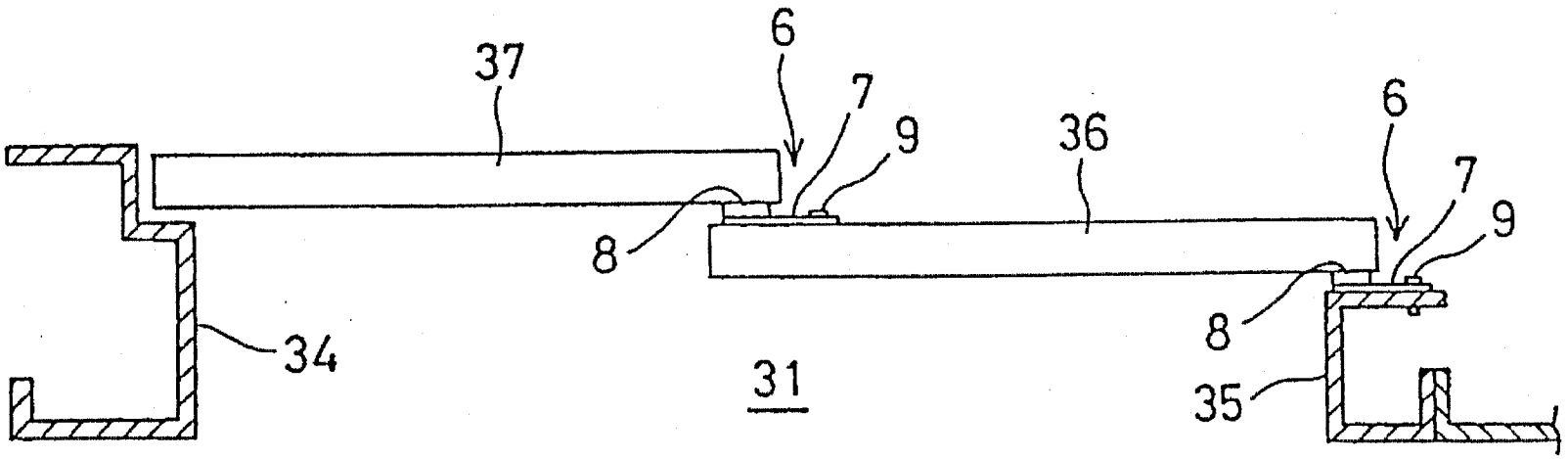
FIG. 7 is a plan view of the entrance and exit of a cage in which another application example of the invention is used.

Furthermore, other application examples are shown in FIGS. 6 and 7, respectively. In FIG. 6, at the entrance and exit 31 of a cage, the doors 32 and 33 of a double-opening type are arranged, and the door wiper 6 is installed at the entrance columns 34 and 35. Also, in FIG. 7, at the entrance and exit 31 of a cage, the doors 36 and 37 with one side-opening type is arranged, and the door wiper 6 is installed at the door 36. The door wiper 6 is also installed at the entrance column 35.

As explained above, according to this invention, an elevator door wiper is constructed by equipping with a base plate material installed in a removable fashion on a member facing the surface of an elevator door and a wiping member installed on this base plate material in contact with the surface of the above-mentioned door for wiping dirt off. When doors are opened and closed, the dirt attached on this surface is automatically wiped by the door wiper. For this reason, the conventional wiping work can be omitted, and the hard labor and time related in the past can be eliminated.

When the doors (4) and (5) are opened (direction of arrow D) and closed (direction of arrow C), the dirt on the surfaces (4*a*) and (5*a*) of these doors is automatically wiped off by means of this door wiper (6). Therefore, the wiping work, conventionally needed, can be eliminated, and the hard labor and time conventionally necessary for this work can be eliminated.

While there has been shown and described what is at present considered preferred embodiments of the present invention, it will be apparent to those skilled in the art that various changes and modifications may be made therein without departing from the spirit and scope of the present invention which shall be limited only by the appended claims.

What is claimed is:

1. An elevator hoistway door wiper system, comprising:

an elevator hoistway door movable in opening and closing directions, said elevator hoistway door having an outer surface;

a stationary rigid member facing said outer surface;

a stationary base plate removably disposed on said stationary rigid member, said base plate including a plurality of L-shaped grooves having sides facing said elevator hoistway door; and a wiping member attached to said base plate and extended from said base plate to said outer surface so that said wiping member contacts and wipes said outer surface when said elevator hoistway door moves in said opening and closing directions.

2. A system as claimed in claim 1, wherein said wiping member is a sponge fixed to said base plate.

3. A system as claimed in claim 1, where said base plate is formed of steel.

4. A system as claimed in claim 1, wherein said rigid stationary member is a stationary side jam forming part of a hoistway entrance of a building.

* * * * *